US012778331B2

(12) United States Patent
Seibert

(10) Patent No.: US 12,778,331 B2
(45) Date of Patent: Nov. 3, 2026

(54) DEVICE FOR SECURING VESSEL WITH NON-CIRCULAR BASE, RELATED ARRANGEMENT AND GAME

(71) Applicant: Chesterfield Seibert, Albany, NY (US)

(72) Inventor: Chesterfield Seibert, Albany, NY (US)

( * ) Notice: Subject to any disclaimer, the term of this patent is extended or adjusted under 35 U.S.C. 154(b) by 30 days.

(21) Appl. No.: 18/808,216

(22) Filed: Aug. 19, 2024

(65) Prior Publication Data

US 2026/0047709 A1 Feb. 19, 2026

(51) Int. Cl.
*A47G 23/02* (2006.01)
*A63F 9/00* (2006.01)

(52) U.S. Cl.
CPC ..... *A47G 23/0208* (2013.01); *A63F 9/001* (2013.01); *A63F 2009/0012* (2013.01); *A63F 2009/0047* (2013.01); *A63F 2250/024* (2013.01)

(58) Field of Classification Search
CPC . A47G 23/0208; A47G 23/0216; A63F 9/001; A63F 2009/0012; A63F 2009/0047; A63F 2250/024
See application file for complete search history.

(56) References Cited

U.S. PATENT DOCUMENTS

| | | | | |
|---|---|---|---|---|
| 4,587,827 | A * | 5/1986 | Wessels | B21D 22/26 72/348 |
| 5,285,907 | A * | 2/1994 | Franchere | F16M 13/00 211/74 |
| 5,653,621 | A | 8/1997 | Yao et al. | |
| 5,941,379 | A * | 8/1999 | Barardo | A47K 11/10 15/210.1 |
| 9,808,734 | B2 | 11/2017 | Kuo et al. | |
| 11,524,217 | B2 * | 12/2022 | Smith | A63B 67/002 |
| 2024/0023742 | A1 * | 1/2024 | Korovilas | B65D 81/3876 |

* cited by examiner

*Primary Examiner* — Andrew D Perreault
(74) *Attorney, Agent, or Firm* — Hoffman Warnick LLC

(57) ABSTRACT

Various implementations include vessel securing devices. In a particular implementation, a device for securing a vessel includes: a body having an upper surface with a recess therein, the recess having a non-circular shape and including at least one retention feature for securing a vessel having a non-circular base; and at least one mating feature along a periphery of the body for joining the device with a second device for securing a second vessel.

18 Claims, 8 Drawing Sheets

DEVICE FOR SECURING VESSEL WITH NON-CIRCULAR BASE, RELATED ARRANGEMENT AND GAME

TECHNICAL FIELD

This disclosure generally relates to devices for securing vessels. More particularly, the disclosure relates to device for securing a vessel with a non-circular, or multi-lobed, shape.

BACKGROUND

Certain uses for vessels can benefit from securing such vessels in place and/or coupling sets of vessels together. For example, securing a fluid carrying vessel or drink carrying vessel can enable desired positioning and/or arranging of one or more vessels. However, conventional devices fail to enable securing vessels in a number of applications.

SUMMARY

All examples and features mentioned below can be combined in any technically possible way.

Various implementations include vessel securing devices. In a particular implementation, a device for securing a vessel includes: a body having an upper surface with a recess therein, the recess having a non-circular shape and including at least one retention feature for securing a vessel having a non-circular base; and at least one mating feature along a periphery of the body for joining the device with a second device for securing a second vessel.

Implementations may include one of the following features, or any combination thereof.

In some cases, the non-circular shape of the recess is multi-lobed.

In particular aspects, the retention feature(s) include a twist-to-secure feature.

In certain implementations, the twist-to-secure feature includes an overhang that engages a lip on the non-circular base while the vessel is in a first orientation and does not engage the lip on the non-circular base while the vessel is in a second orientation.

In some examples, the lip on the non-circular base of the vessel is a flare-out at the base of the vessel (e.g., cup). The lip or flare-out is also called a taper in certain cases.

In certain implementations, the second orientation enables loading or unloading of the vessel from the device.

In particular aspects, the recess has an approximately square shape, an approximately rounded square shape, an approximately hexagonal shape, or an approximately triangular shape. In some examples, the recess shape corresponds approximately with the shape of the vessel base.

In some cases, the body further includes at least one loading or unloading feature that is distinct from the at least one retention feature. In certain cases, the loading or unloading features include openings for receiving edges (e.g., corners) of the base of the vessel. The openings can enable insertion and/or removal of the vessel from the body.

In certain aspects, the loading or unloading feature has a profile that differs from a profile of the retention feature. In certain examples, the profile of the loading or unloading feature complements a profile of the retention feature, e.g., enabling engagement between the features.

In some cases, the loading or unloading feature includes a guide feature. In some examples, the guide feature includes dots, lines, arrows, contrast in color, etc.

In particular implementations, the device includes a target location feature to aid in locating the vessel relative to the at least one retention feature. In some cases, the target location feature includes dots, lines, arrows, contrast in color, etc., for locating corners of the vessel once inserted and rotated.

In some aspects, the retention feature(s) provide rotational resistance and axial resistance to the vessel while the vessel is in a first orientation.

In certain cases, the retention feature(s) provide greater axial resistance than rotational resistance.

In particular implementations, the periphery of the body includes a plurality of mating features for joining the device with a plurality of additional devices for holding a respective vessel in a multi-vessel arrangement. In particular examples, the mating features can include dovetails, tongue and groove features, male and female connectors, tab and slot connectors, adhesive, interlocking woven fibers, etc.

In some cases, each of the plurality of mating features complements a corresponding mating feature on the additional devices.

In particular aspects, the plurality of mating features includes at least two mating features for coupling the device with at least two additional devices.

In certain implementations, each side of the body contains at least two mating features for coupling with neighboring devices. In further examples, the body can include a naturally tessellating shape such as a hexagon, square, or equilateral triangle.

In certain cases, the sides of the body are configured to mate with a plurality (e.g., three, four, or six) neighboring parts, based on the shape of the body.

In some aspects, the device includes a grip feature on a lower surface of the body for mitigating sliding of the device. In particular aspects, the grip feature includes a material that is distinct from a remainder of the body, e.g., a high-friction material. In further cases, the grip feature includes a surface texture in the body.

In particular cases, the body is formed of plastic, metal, or a composite.

In certain implementations, the device further includes a first stacking feature on the upper surface of the body and a second stacking feature on the lower surface of the body, where the first and second stacking features enable vertical stacking of the device with additional devices. In some examples, stacking features can include slots and tabs for stacking, transporting, and/or storage of a set of devices.

Certain implementations include a multi-cup game including the device.

In particular implementations including the multi-cup game, the vessel includes a drink cup and the multi-cup game includes a ball-based game such as drink pong.

In additional implementations, the vessel includes a candle holder and/or a fluid vessel holder.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
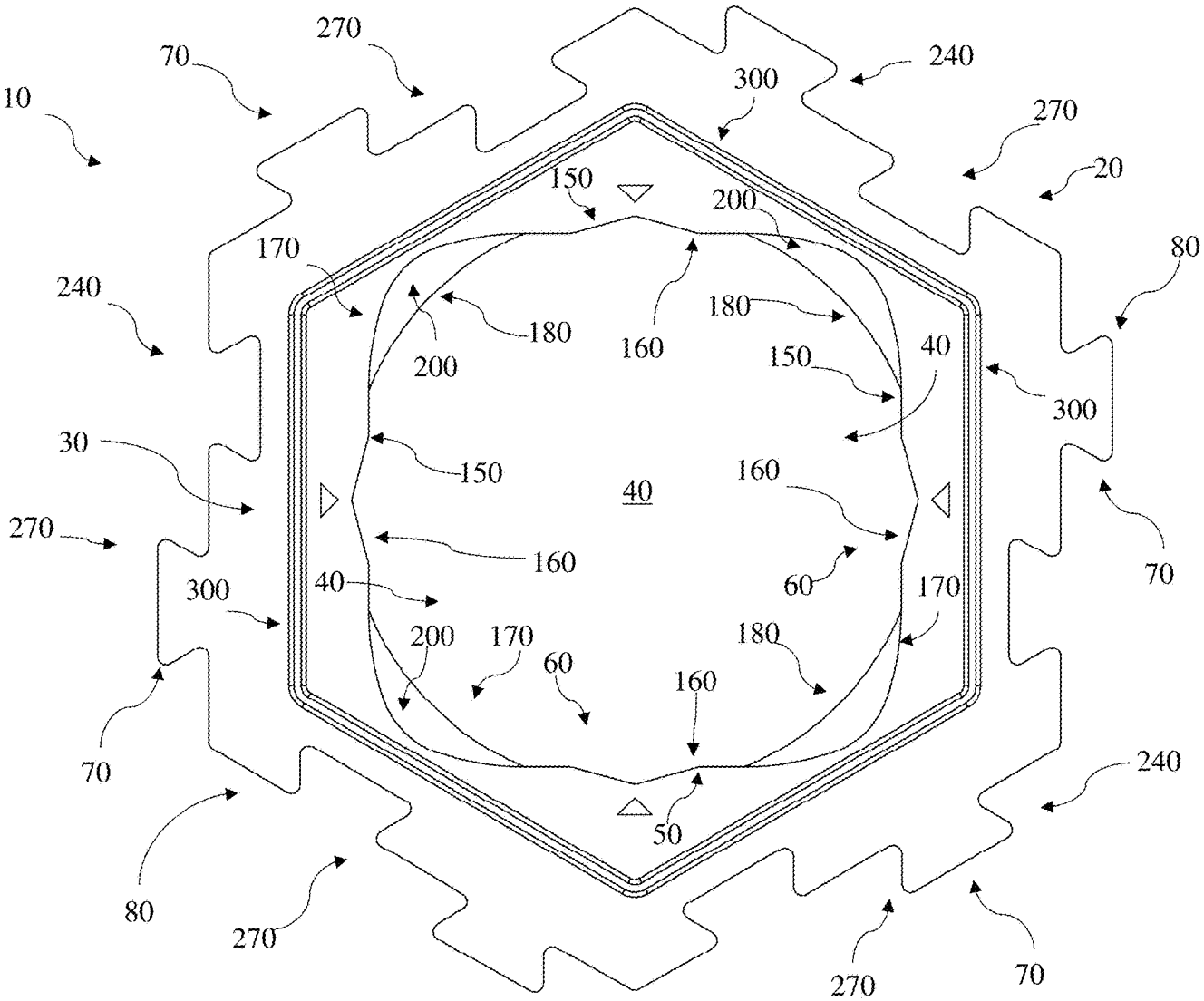
FIG. 1 shows a plan view of a first side of a vessel holder according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure provides, at least in part, a device for securing a vessel, such as a fluid vessel or a candle holder. In particular implementations, the device includes a body with at least one retention feature for securing the vessel, and one or more mating feature(s) along a periphery of the body for joining the device with a second device for securing a second vessel. In particular implementations, the device is configured to secure the vessel, and in some examples, interface with a set of additional devices for securing additional vessels.

Commonly labeled components in the FIGURES are considered to be substantially equivalent components for the purposes of illustration, and redundant discussion of those components is omitted for clarity.

Figure 2:
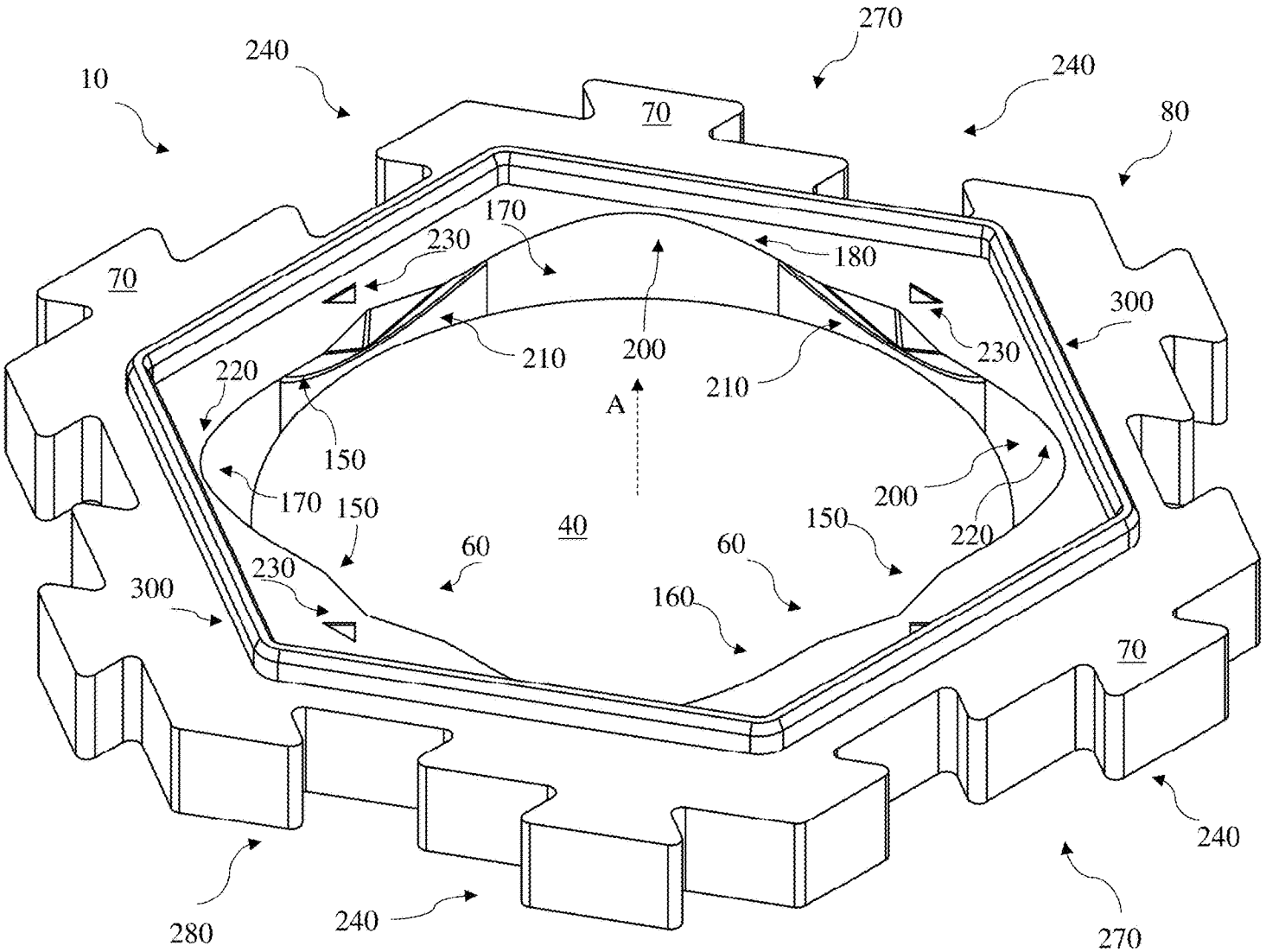
FIG. 2 shows a perspective view of the vessel holder of FIG. 1.

FIG. 1 shows a plan view of a device 10 for securing a vessel. FIG. 2 shows the device 10 in perspective view. In certain implementations, the vessel can include a fluid vessel such as a drink vessel, e.g., a plastic, glass, ceramic, or other drink vessel. In other cases, the vessel can include a candle holder, a vase, etc. In a particular implementation, the vessel can include a non-circular base. For example, the vessel can include a base having an approximately square shaped bottom. In some cases, the bottom of the vessel has rounded junctions between sides (e.g., rounded outer edges) but approximates a square shape. In any case, the vessel has a base that is not circular.

As shown in FIGS. 1 and 2, the device 10 includes a body 20 having an upper surface 30 with a recess 40 therein. In particular cases, the recess 40 has a non-circular shape 50, and includes at least one retention feature 60 for securing a vessel having a non-circular base. In particular implementations, the non-circular shape 50 is also referred to as multi-lobed. In certain aspects, the recess 40 has an approximately square shape, an approximately rounded square shape, an approximately hexagonal shape, or an approximately triangular shape. In some examples, the recess 40 shape corresponds approximately with the shape of the vessel base.

In certain cases, the device 10 also includes at least one mating feature 70 along a periphery 80 of the body 20 for joining the device 10 with a second device (e.g., device 10A, FIG. 9) configured to secure a second vessel.

Figure 3B:
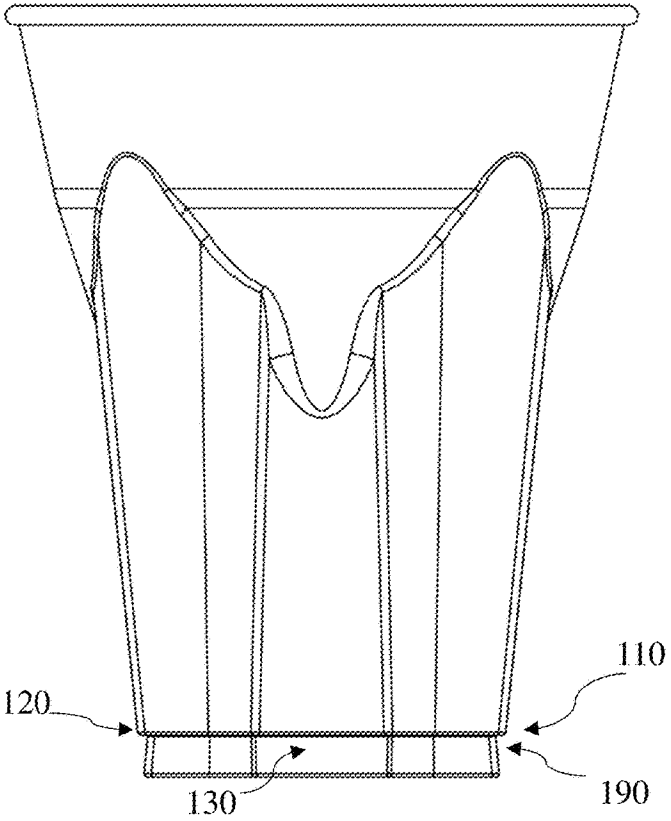
FIG. 3B shows an example side view of the vessel in FIG. 3A.
Figure 3A:
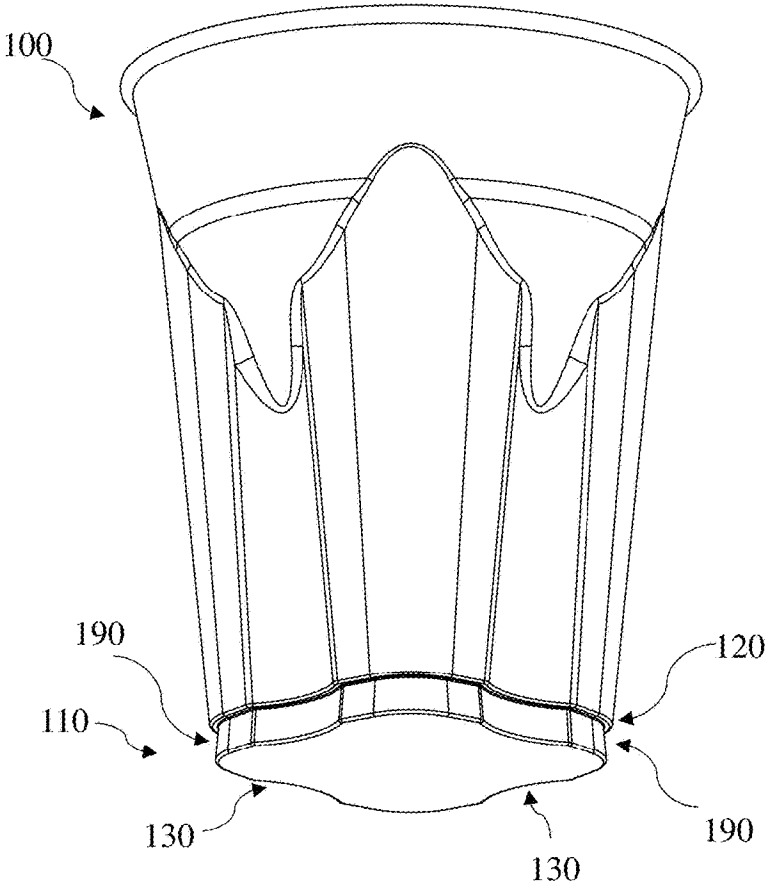
FIG. 3A shows an example perspective view of a vessel having a non-circular bottom according to certain implementations.

FIGS. 3A and 3B show an example vessel 100 configured to be retained by the device 10 in certain implementations. The vessel 100 can include a non-circular base 110 as described herein, and in particular cases, includes a lip 120 extending around at least a portion of the non-circular base 110. In some examples, the lip 120 is a flare-out at the base 110 of the vessel (e.g., cup). The lip or flare-out 120 is also called a taper in certain cases. In this example, the non-circular base 110 approximates a square shape, however, can include one or more contours (or recesses) 130 therein. It is understood that vessel 100 is merely one non-limiting example of a vessel configured to engage with the device 10. In certain cases, the vessel 100 includes a liquid holder such as a drink cup. In some cases, the vessel 100 includes a disposable drink cup.

Figure 4:
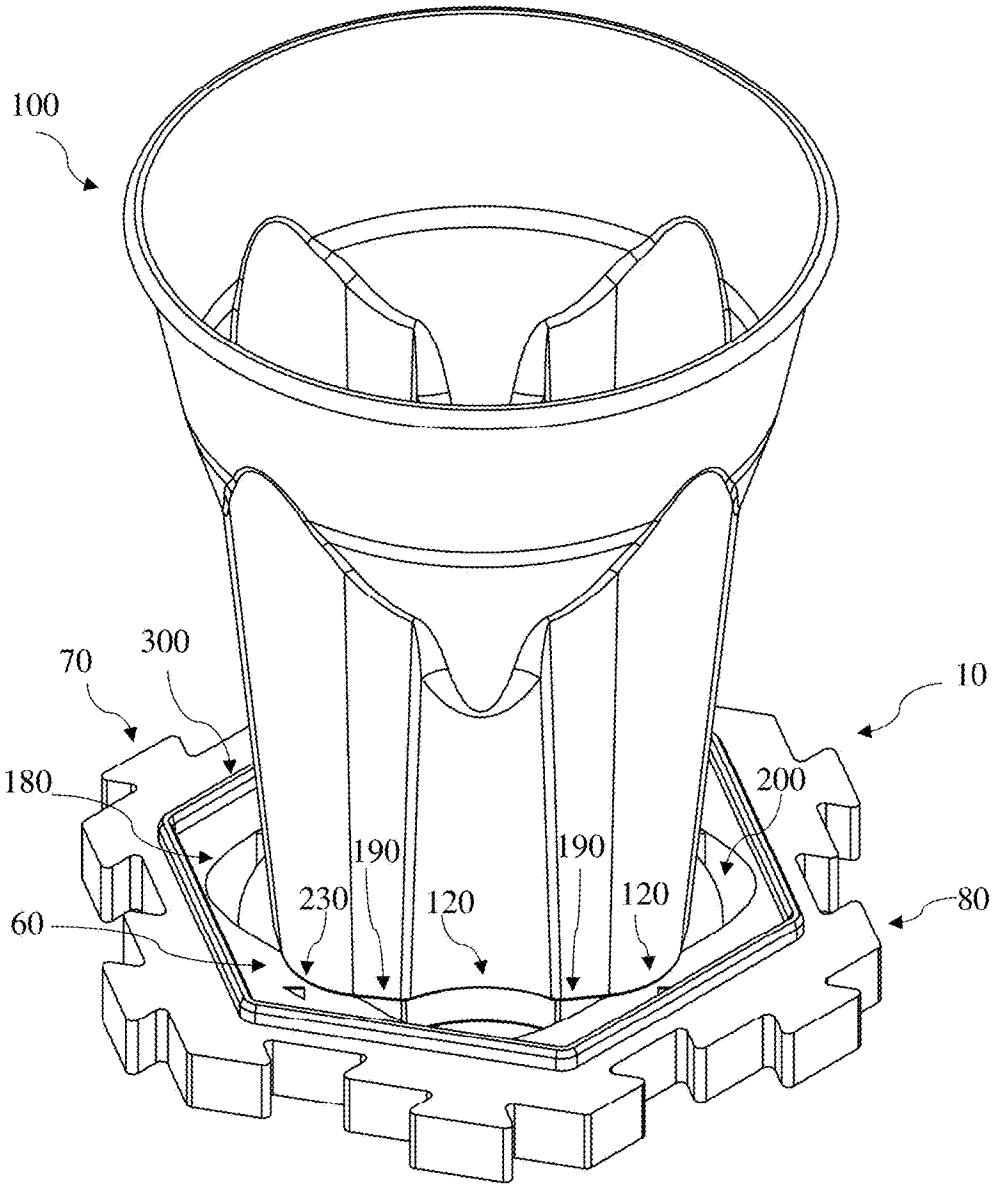
FIG. 4 illustrates an example vessel coupled with a device according to various implementations.

FIG. 4 illustrates the example vessel 100 coupled with the device 10 according to various implementations. As described herein, the vessel 100 can be retained by the retention feature 60 in a first (or, secured) orientation, and can be configured to move (e.g., for loading or unloading) relative to the device 10 in a second orientation. FIG. 5A shows a plan view of an example vessel (e.g., vessel 100) and device 10 according to certain implementations, for example, in the secured orientation. FIG. 5A is a cross-sectional view of vessel 100 coupled with the device 10, taken through line 5-5 in FIG. 5 FIG. 6 is a close-up view of a section of the connection between the vessel 100 and device 10, e.g., at the lip 120.

Figure 5:
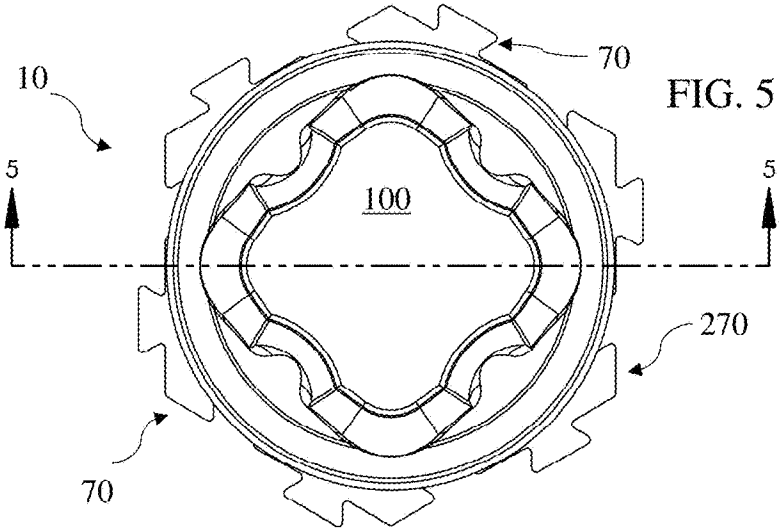
FIG. 5 is a top view of an example vessel coupled with a device according to various implementations.
Figure 6:
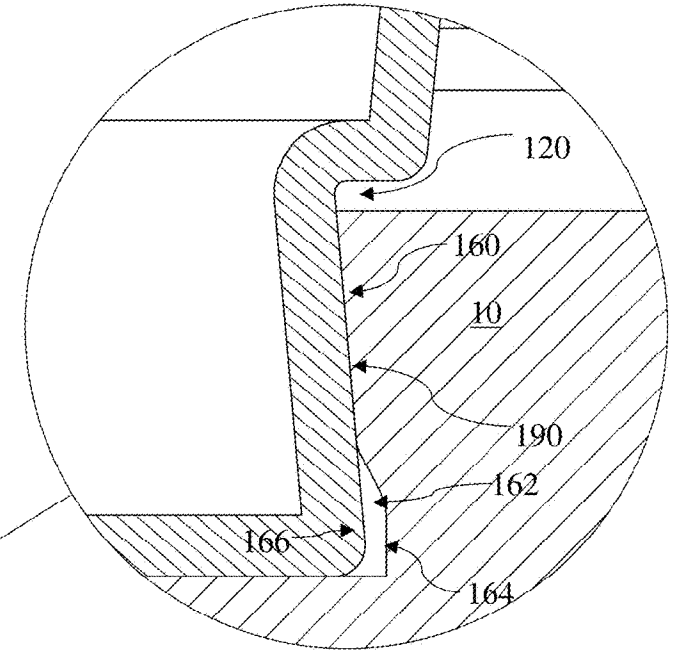
FIG. 6 is a close-up view of a section of the connection between the vessel and device in FIG. 5A.
Figure 5A:
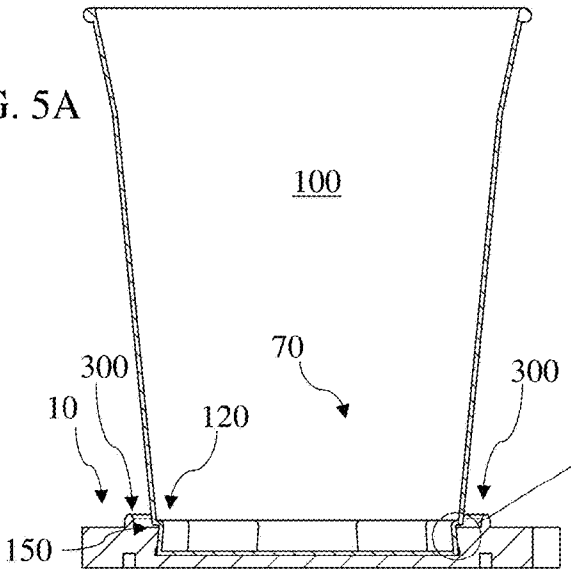
FIG. 5A is a cross-sectional view of the vessel and device taken through line 5-5 in FIG. 5, according to various implementations.

Returning to FIGS. 1 and 2, and with continuing reference to FIGS. 4-6, in particular cases, the retention feature 60 includes a twist-to-secure feature 150. In certain of these cases, the twist-to-secure feature 150 includes an overhang 160 that engages the lip 120 on the non-circular base 110 while the vessel (e.g., vessel 100) is in a first orientation, e.g., a secured orientation. In particular cases, the overhang 160 does not engage the lip 120 on the non-circular base 110 while the vessel 100 is in a second orientation, e.g., a loading or unloading orientation. In particular cases, the vessel 100 can be loaded or unloaded from the device 10 in the first orientation such that the twist-to-secure feature 150 does not interfere with the non-circular base 100. Once placed in the device 10, the vessel 100 can be rotated such that the overhang 160 engages the lip 120, retaining the vessel 100 relative to the device 10. In various examples, the overhang 160 enables the vessel 100 to be rotated in either direction (e.g., clockwise or counter-clockwise) relative to axis A to engage/disengage the twist-to-secure feature 150. In some cases, the overhang 160 includes an arcuate lower surface that engages the lip 120 and enables rotation of the lip 120 in either the clockwise or counter-clockwise directions to engage or disengage the twist-to-secure feature 150. In certain cases, as shown in the secured orientation view in FIG. 6, a gap 162 exists between an underside 164 of the overhang 160 and an outer surface 166 of the vessel 100.

In some aspects, as seen in FIGS. 1 and 2, the body 20 can further include one or more loading or unloading features 170 that are distinct from the retention feature(s) 60. In certain cases, the loading or unloading feature(s) 170 include openings 180 for receiving edges (e.g., corners) 190 of the base 110 of the vessel 100 (FIGS. 3A and 3B). The openings 180 can enable insertion and/or removal of the vessel 100 from the body 20.

In particular cases, the loading or unloading feature 170 has a profile 200 that differs from a profile 210 of the retention feature 60 (FIG. 2). In certain examples, the profile 200 of the loading or unloading feature 170 complements the profile 210 of the retention feature 60, e.g., enabling engagement between the features 170, 60. In some cases, the loading or unloading feature 170 includes a guide feature 220. In some examples, the guide feature 220 includes dots, lines, arrows, contrast in color, etc. FIGS. 1 and 2 show a non-limiting example of guide features 220 including arrows.

In further implementations, the device 10 includes a target location feature 230 to aid in locating the vessel 100 relative to the at least one retention feature 60. In some cases, the target location feature 230 includes dots, lines, arrows, contrast in color, etc., for locating edges (e.g., corners) 190 of the vessel 100 once inserted and rotated.

In some aspects, the retention feature(s) 60 provide rotational resistance and axial resistance to the vessel 100 while the vessel 100 is in a first orientation, e.g., secured in the device 10. In some aspects, the retention feature(s) 60 provide greater axial resistance (e.g., along axis A, FIG. 2) than rotational resistance (e.g., rotation relative to axis A).

Figure 9:
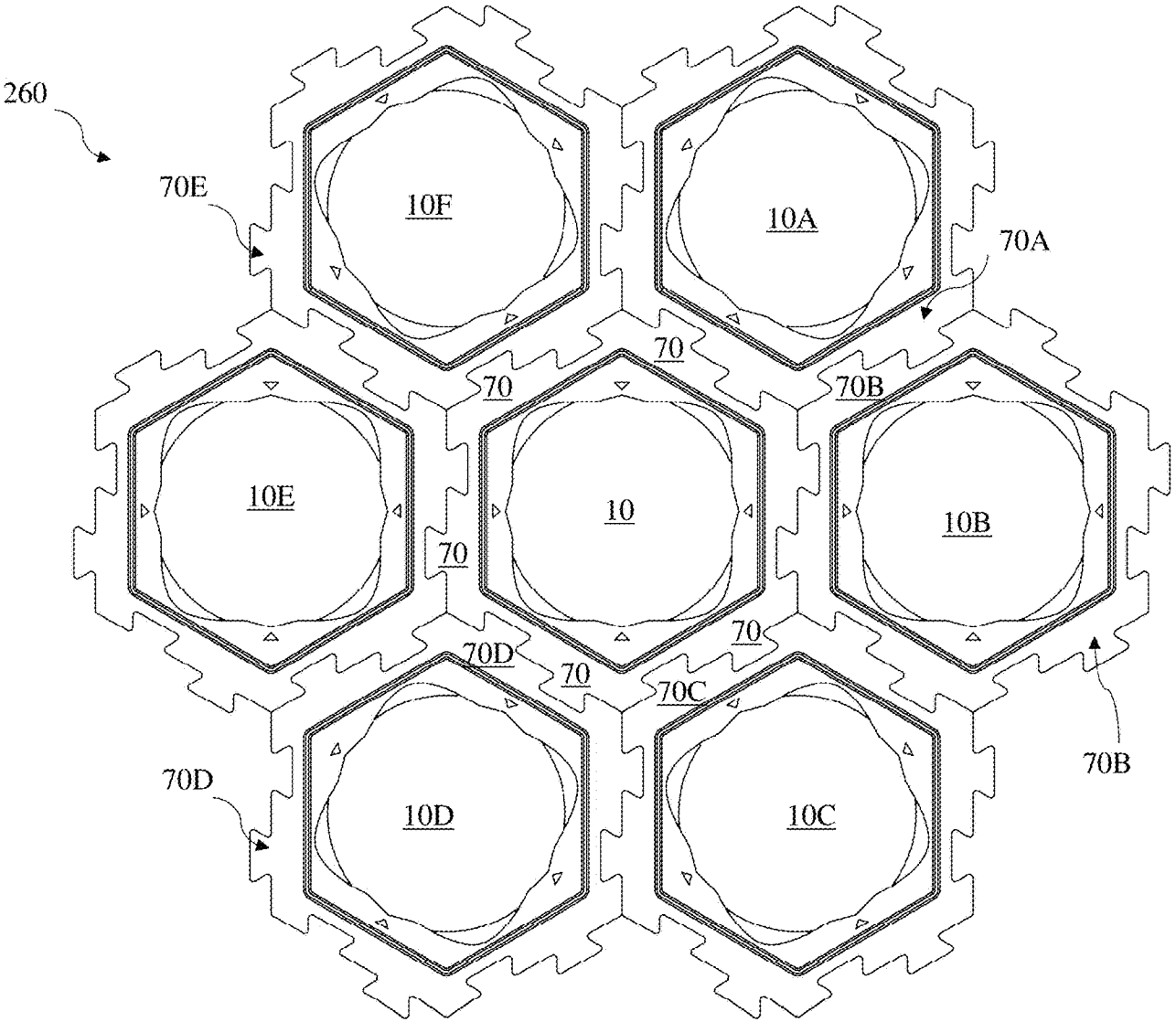
FIG. 9 is a plan view of a set of vessel holders according to various implementations.

In particular implementations, the periphery 240 of the body 20 includes a plurality of the mating features 70 for joining the device 10 with a plurality of additional devices (e.g., 10A, 10B, 10C, 10D, 10E, 10F) for holding a respective vessel in a multi-vessel arrangement 260, as shown in FIG. 9. In particular examples, the mating features 70 can include dovetails, tongue and groove features, male and female connectors, tab and slot connectors, adhesive, interlocking woven fibers, etc., that are configured to enable removable coupling between two or more devices 10 in a multi-vessel arrangement 260. In some cases, each of the plurality of mating features 260 complements a corresponding mating feature 70A, 70B, 70C, etc. on the additional devices (e.g., 10A, 10B, 10C, etc.) as illustrated in FIG. 9. In particular aspects, the plurality of mating features 70 includes at least two mating features 70 for coupling the device with at least two additional devices 10A, 10B, etc. In certain implementations, each side 270 of the body 20 contains at least two mating features 70 for coupling with neighboring devices 10A, 10B, etc. In further examples, the body 20 can include a naturally tessellating shape such as a hexagon, square, or equilateral triangle. In certain cases, the sides 270 of the body 20 are configured to mate with a plurality (e.g., three, four, or six) neighboring parts, based on the shape of the body 20.

Figure 7:
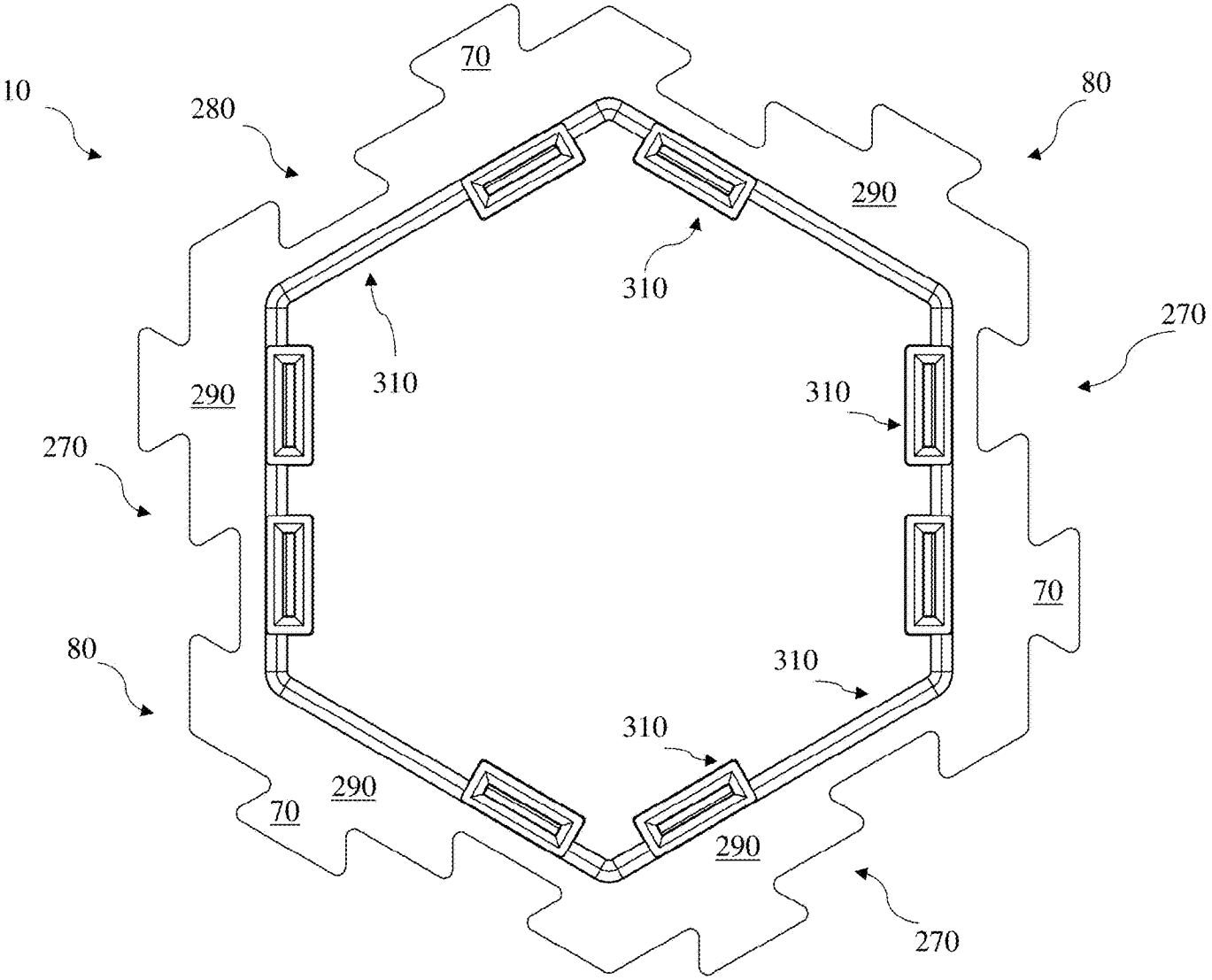
FIG. 7 shows a second side of the vessel holder of FIG. 1 according to various implementations.
Figure 8:
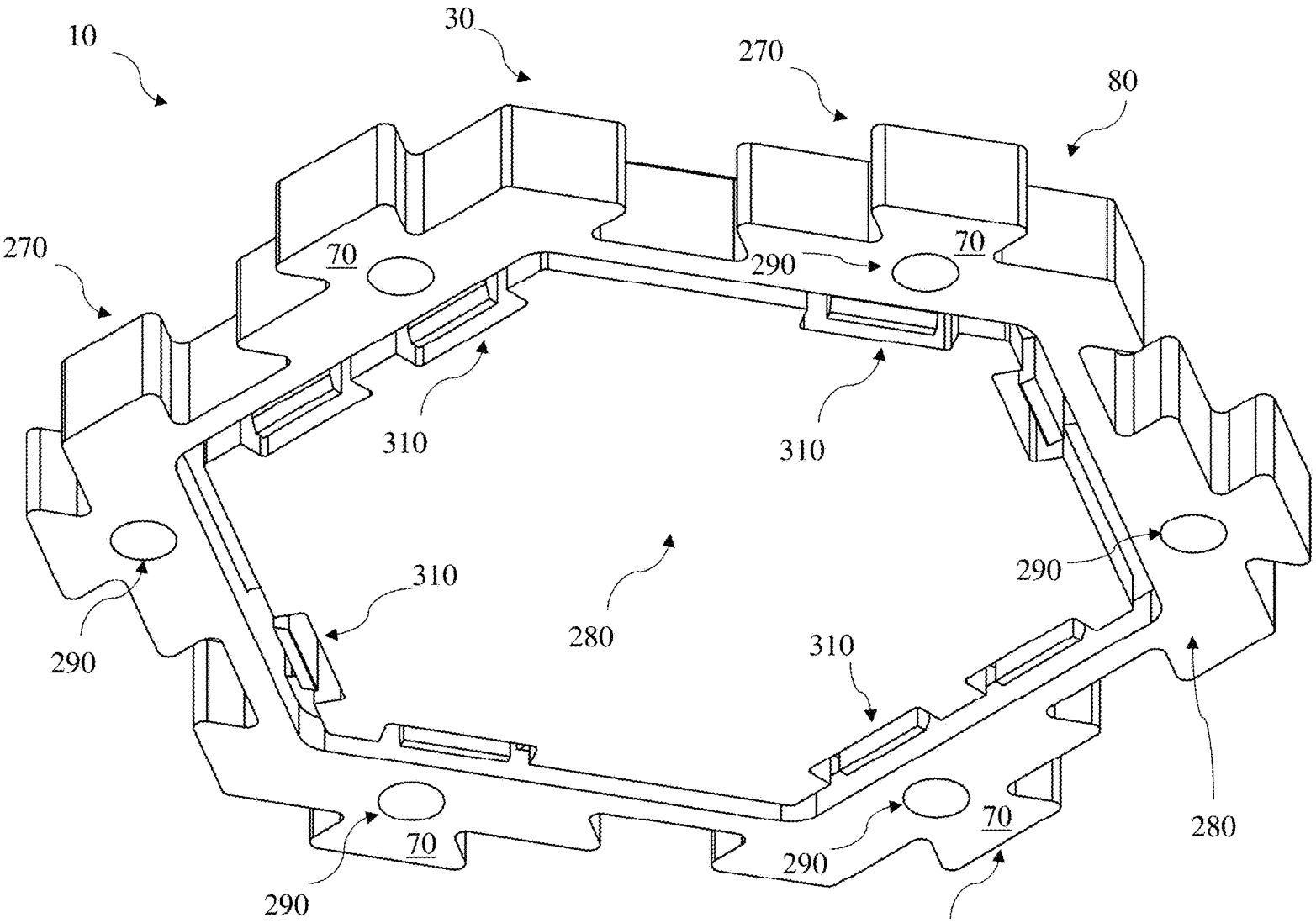
FIG. 8 shows a perspective view of the second side of the vessel holder of FIGS. 3A and 3B according to various implementations.

FIGS. 7 and 8 illustrate plan and perspective views, respectively, of the lower surface 280 of the body 20, which opposes the upper surface 30 in various implementations. In some cases, the lower surface 280 includes a grip (or grip feature) 290 for mitigating sliding of the device 10, e.g., relative to a surface. In particular aspects, the grip feature 290 includes a material that is distinct from a remainder of the body 20, e.g., a high-friction material. In further cases, the grip feature 290 includes a surface texture in the body, e.g., a ribbing, set of slots, dimples, or another texture. In particular cases, the body 20 is formed of plastic, metal, or a composite.

As also illustrated in FIGS. 7 and 8, as well as FIGS. 1 and 2, the device 10 can optionally include a first stacking feature 300 on the upper surface 30 of the body 20 and a second stacking feature 310 on the lower surface 280 of the body 20. The first 300 and second 310 stacking features can enable vertical stacking of the device 10 with additional devices 10A, 10B, 10C, etc. (FIG. 9). In some examples, stacking features 300, 310 can include slots and tabs for stacking, transporting, and/or storage of a set of devices 10. In various implementations, the first stacking feature 300 complements the second stacking feature 310, such that the combined thickness of two stacked devices 10 is less than the thickness of two devices 10 added together. In a particular example, the first stacking feature 300 includes a ridge or protrusion, and the second stacking feature 310 includes one or more slots that complement the ridge or protrusion.

In particular implementations, as shown in the arrangement 260, the device 10 can be used to facilitate a multi-vessel arrangement. In certain cases, the arrangement 260 is part of a multi-cup game that includes use of the device 10 and additional devices 10A, 10B, 10C, etc. In particular implementations including the multi-cup game, the vessel 100 includes a drink cup and the multi-cup game includes a ball-based game such as drink pong. In some examples, a set of devices 10 can be arranged to facilitate a multi-cup game, such as drink pong, where the vessels are positioned adjacent to one another. In certain cases, the mating features 70 on the set of devices 10 enable locating the vessels 100 in the arrangement 260 such that only nominal separation exists between vessels 100 in adjacent devices 10. In particular cases, the adjacent vessels 100 just contact one another, or are only minimally separated.

As noted herein, in other cases, the vessel 100 includes a candle holder and/or a fluid vessel holder. In some such cases, the device 10 can enable arrangement of a set of candles and/or fluid vessels (e.g., in an arrangement similar to arrangement 260 or another shape). In certain implementations, a set of devices 10 enables arrangement of vessels 100 with nominal separation between those vessels 100, which can enable a beneficial esthetic arrangement of vessels.

As noted herein, the device 10 disclosed according to various implementations provide numerous benefits relative to conventional vessel holders. For example, the devices disclosed herein can enable efficient engagement and disengagement of a vessel such as a candle holder or a drink cup with an insert-and-rotate or rotate-and-remove motion. The retention feature(s) 60 are configured to engage a lip on the vessel in a first orientation, while enabling movement of the vessel relative to the device in a second orientation. The device 10 can prevent tipping of the vessel during use. Further, the device 10 can retain (and stabilize) the vessel during use in a game such as a multi-cup game like drink pong. The device 10 can also enable positioning of a plurality of vessels in a multi-vessel arrangement, e.g., in a multi-cup game. Further, the device 10 can enable efficient and space-saving storage when grouped with a plurality of devices, e.g., via stacking.

It is understood that the relative proportions, sizes and shapes of the device 10 and components and features thereof as shown in the FIGURES included herein can be merely illustrative of such physical attributes of these components. That is, these proportions, shapes and sizes can be modified according to various implementations to fit a variety of products. For example, while a substantially hexagonal shaped device may be shown according to particular implementations, it is understood that the device could also take on other three-dimensional shapes in order to provide vessel retention functions described herein.

The term "approximately" as used with respect to values herein can allot for a nominal variation from absolute values, e.g., of several percent or less. Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). Similarly, the term "in response to" is used to indicate any of its ordinary meanings, including "in response to at least."

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

I claim:

1. A device for securing a vessel, the device comprising:

a body having an upper surface with a recess therein, the recess having a non-circular shape and including at least one retention feature for securing a vessel having a non-circular base;

wherein the body further includes at least one loading or unloading feature that is distinct from the at least one retention feature, wherein the loading or unloading feature has a profile that differs from a profile of the retention feature, and wherein the loading or unloading feature includes openings for receiving corners of the non-circular base of the vessel, the openings enabling insertion and/or removal of the vessel from the body, wherein the non-circular base includes a lip extending around at least a portion of the non-circular base, the lip including a flare out, wherein the at least one loading or unloading feature includes a guide feature and a target location feature to aid in locating the vessel relative to the at least one retention feature; and at least one mating feature along a periphery of the body for joining the device with a second device for securing a second vessel.

2. The device of claim 1, wherein the at least one retention feature includes a twist-to-secure feature.

3. The device of claim 2, wherein the twist-to-secure feature includes an overhang that engages a lip on the non-circular base while the vessel is in a first, secured orientation and does not engage the lip on the non-circular base while the vessel is in a second, loading or unloading orientation.

4. The device of claim 1, wherein the recess has an approximately square shape, an approximately rounded square shape, an approximately hexagonal shape, or an approximately triangular shape.

5. The device of claim 1, wherein the at least one retention feature provides rotational resistance and axial resistance to the vessel while the vessel is in a first orientation and provides greater axial resistance than rotational resistance.

6. The device of claim 1, wherein the periphery of the body includes a plurality of mating features for joining the device with a plurality of additional devices for holding a respective vessel in a multi-vessel arrangement, wherein each of the plurality of mating features complements a corresponding mating feature on the additional device.

7. The device of claim 6, wherein the plurality of mating features includes at least two mating features for coupling the device with at least two additional devices, wherein each side of the body contains at least two mating features for coupling with neighboring devices.

8. The device of claim 1, further comprising a grip feature on a lower surface of the body for mitigating sliding of the device, wherein the grip feature includes a surface texture.

9. The device of claim 1, further comprising a first stacking feature on the upper surface of the body and a second stacking feature on the lower surface of the body, wherein the first and second stacking features enable vertical stacking of the device with additional devices.

10. A multi-cup game including the device of claim 1, wherein the vessel includes a drink cup and wherein the multi-cup game includes drink pong.

11. The device of claim 1, wherein the vessel includes a non-circular fluid vessel holder that approximates a square shape.

12. The device of claim 3, wherein the twist-to-secure feature does not interfere with the non-circular base in the first, secured orientation.

13. The device of claim 12, wherein in the first, secured orientation a gap exists between an underside of the overhang and an outer surface of the vessel.

14. A device for securing a vessel, the device comprising:

a body having an upper surface with a recess therein, the recess having a non-circular shape;

at least one retention feature for securing a vessel having a non-circular base, wherein the non-circular base includes a lip extending around at least a portion of the non-circular base, the lip including a flare-out, wherein the body further includes at least one loading or unloading feature that is distinct from the at least one retention feature, wherein the loading or unloading feature has a profile that differs from a profile of the retention feature, wherein the loading or unloading feature includes openings for receiving the corners of the non-circular base of the vessel, the openings enabling insertion and/or removal of the vessel from the body, wherein the at least one loading or unloading feature includes a guide feature and a target location feature to aid in locating the vessel relative to the at least on retention feature, and wherein the at least one retention feature including a twist to secure feature including an overhang that engages the flare-out in the lip on the non-circular base of the vessel while the vessel is in a first, secured orientation and does not engage the lip on the non-circular base of the vessel while the vessel is in a second, loading or unloading orientation, wherein the vessel is capable of moving between first, secured orientation and the second, loading or unloading orientation with a twisting movement; and at least one mating feature along a periphery of the body for joining the device with a second device for securing a second vessel.

15. The device of claim 14, wherein the vessel includes a drink cup, wherein the loading or unloading feature is distinct from the at least one retention feature and has a profile that differs from a profile of the retention feature.

16. The device of claim 15, wherein the periphery of the body includes a plurality of mating features for joining the device with a plurality of additional devices for holding a respective vessel in a multi-vessel arrangement, and each of the plurality of mating features complements a corresponding mating feature on the additional devices.

17. A multi-cup game comprising:

a set of devices each comprising:

a body having an upper surface with a recess therein, the recess having a non-circular shape;

at least one retention feature for securing a base of a drink cup having a non-circular base;

wherein the body further includes at least one loading or unloading feature that is distinct from the at least one retention feature, wherein the loading or unloading feature has a profile that differs from a profile of the retention feature, and wherein the loading or unloading feature includes openings for receiving corners of the non-circular base of the drink cup, the openings enabling insertion and/or removal of the drink cup from the body, wherein the non-circular base includes a lip extending around at least a portion of the non-circular base, the lip including a flare-out, wherein the at least one loading or unloading feature includes a guide feature and a target location feature to aid in locating the drink cup relative to the at least one retention feature, a twist to secure feature wherein the twist-to-secure feature includes an overhang that engages a lip on the base of the drink cup while the drink cup is in a first, secured orientation and does not engage the lip on the base of the drink cup while the drink cup is in a second, unsecured orientation and, wherein the second orientation enables loading and/or unloading of the drink cup from the device; and a plurality of mating features along a periphery of the body for joining the device with a plurality of additional devices in the set for holding a respective drink cup in a multi-cup arrangement as part of a multi-cup drink pong game.

18. The set of devices in claim 17, wherein the twist-to-secure feature does not interfere with the non-circular base in the first, secured orientation.

* * * * *